US009762005B2

(12) United States Patent
Wang

(10) Patent No.: US 9,762,005 B2
(45) Date of Patent: Sep. 12, 2017

(54) INSULATIVE FIXING PLATE DAMAGED WHEN OVERHEATING AS WELL AS A PLUG AND A SOCKET USING THAT INSULATIVE FIXING PLATE

(71) Applicant: Chuan-Sheng Wang, Tainan (TW)

(72) Inventor: Chuan-Sheng Wang, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

(21) Appl. No.: 15/036,203

(22) PCT Filed: Apr. 14, 2015

(86) PCT No.: PCT/CN2015/076561

§ 371 (c)(1),
(2) Date: May 12, 2016

(87) PCT Pub. No.: WO2016/165073

PCT Pub. Date: Oct. 20, 2016

(65) Prior Publication Data

US 2017/0110836 A1 Apr. 20, 2017

(51) Int. Cl.
*H01R 13/66* (2006.01)
*H01R 13/696* (2011.01)
(Continued)

(52) U.S. Cl.
CPC ..... *H01R 13/696* (2013.01); *H01R 24/20* (2013.01); *H01R 24/28* (2013.01); *H01R 2103/00* (2013.01)

(58) Field of Classification Search
CPC .... H01R 13/666; H01R 13/713; H01R 13/68; H01R 4/2429; H01R 31/065; H01H 85/2035
(Continued)

(56) References Cited

U.S. PATENT DOCUMENTS 6,067,004 A * 5/2000 Hibayashi ..... H01H 85/044 337/186
6,275,135 B1 * 8/2001 Hibayashi ..... H01H 85/044 337/186
(Continued)

FOREIGN PATENT DOCUMENTS

CN 2321128 Y 5/1999
CN 201008056 Y 1/2008
(Continued)

*Primary Examiner* — Hien Vu

(74) *Attorney, Agent, or Firm* — Muncy, Geissler, Olds & Lowe, P.C.

(57) ABSTRACT

An insulative fixing plate damaged when overheating limits two conductive elements from contacting with each other, forming a closed path, when overheating, opening two conductive elements by an elastic force to form an open circuit. Each conductive element has a groove concaved in from an edge, and the groove has a groove width. The insulative fixing plate includes a connecting element and two limiting elements combined at two ends of the connecting element. Each limiting element has a working width larger than the groove width, and a holding space between the two limiting elements contains the two conductive elements, thereby abutting the two limiting elements at an external side of the conductive element respectively and limiting the two conductive elements from contacting with each other. The connecting element is damaged when overheating. The insulative fixing plate is used in overheat protection for a plug or a socket.

27 Claims, 15 Drawing Sheets

(51) Int. Cl.
*H01R 24/20* (2011.01)
*H01R 24/28* (2011.01)
*H01R 103/00* (2006.01)

(58) Field of Classification Search
USPC ..... 439/620.08, 0.26, 0.3, 0.31
See application file for complete search history.

(56) References Cited

U.S. PATENT DOCUMENTS 6,276,969 B1 * 8/2001 Unno ..... H01H 85/0241
361/22
7,104,845 B2 * 9/2006 Higuchi ..... H01H 85/044
439/620.26

FOREIGN PATENT DOCUMENTS

| | | | |
|---|---|---|---|
| CN | 201243139 | Y | 5/2009 |
| GB | 2273006 | A | 6/1994 |
| TW | I371053 | B | 8/2012 |
| TW | M477079 | U | 4/2014 |

* cited by examiner

INSULATIVE FIXING PLATE DAMAGED WHEN OVERHEATING AS WELL AS A PLUG AND A SOCKET USING THAT INSULATIVE FIXING PLATE

BACKGROUND OF THE INVENTION a) Field of the Invention

The present invention relates to an insulative fixing plate damaged when overheating as well as a plug and a socket using that insulative fixing plate. The insulative fixing plate damaged when overheating is a fixing element for combination and enables two conductive elements to be limited from contacting with each other, thereby forming a closed path. In addition, the insulative fixing plate is damaged when overheating, which allows the two conductive elements to be opened with respect to each other by an elastic force, thereby forming an open circuit. According to the present invention, the insulative fixing plate damaged when overheating, is further used in overheat protection for a plug or a socket.

b) Description of the Prior Art

To prevent a circuit from current overloading, short-circuit or overheating, the circuit will be usually provided with a fuse or a breaker. When the circuit temperature is too high or the current is too large, the fuse will be melted down by high temperature or the metal spring leaves of the breaker will be ejected, which forms an open circuit to power off the circuit, thereby securing the safety in using electricity.

For the prior art related to the fuse structure, there is a Taiwanese Invention Patent Publication No. I371053, "Thermal Fuse Connecting Structure." The invention includes primarily two terminals which are connected together to form a closed path, and a hot-melt metal which is combined on the two terminals. When the circuit current is overloaded, the circuit is overheated or the environmental temperature under which the circuit is used is too high, the hot-melt metal will be melted and broken by the rise of temperature due to heat-up, so that the two terminals will not be connected with each other, thereby forming an open circuit state.

However, the hot-melt metal disclosed in the prior art is a conductive material; therefore, when the hot-melt metal is melted and broken, if part of residual of the hot-melt metal is attached on the two terminals, then that residual of the hot-melt metal can easily result in miss contact between the two terminals, thereby being unable to power off the circuit completely. On the other hand, the melted and split hot-melt metal can be ejected off by the two terminals that are opened with respect to each other to form an open circuit, and thus collide with other object to form miss contact, causing short-circuit. Accordingly, it is still dangerous in using that invention.

In order to deal with that issue, a Taiwanese Utility Model Patent No. M477079, "Overheat Failure Safety Structure and a Plug and a Socket with the Overheat Failure Safety Structure," was disclosed. This patent claims an insulative limiting element which connects two conductive elements to form a closed path. When the circuit is overheated, the insulative limiting element will be melted and broken, allowing the two conductive elements to be opened with respect to each other by an elastic force to form an open circuit. The limiting element is provided with a first insulative part and an opposite second insulative part. A connecting part is used to connect the first insulative part with the second insulative part, forming a U-shaped appearance and having an open end. The two conductive elements are clamped tightly at the open end.

Upon practically using that patent, the present inventor has found out that as the U-shaped limiting element may not have sufficient rigidity of combination, even the closed path between the two conductive elements is not overheated, the binding force of the U-shaped limiting element can be still reduced due to heat-up and the limiting element can be ejected off by the elastic force between the two conductive elements, thereby forming an open circuit between the two conductive elements. On the other hand, when the temperature between the two conductive elements is too high, the first insulative part and the second insulative part of the U-shaped limiting element will be ejected off by the elastic force between the two conductive elements. However, as the connecting part is still connected at the first insulative part and the second insulative part, the U-shaped limiting element will maintain a part of the binding force, so that the two conductive elements will keep partly contact, thereby being unable to power off the circuit completely. All the two situations described above are the possible false actions.

SUMMARY OF THE INVENTION

Accordingly, in order to solve the possible false actions of the abovementioned limiting element, the present invention further discloses an insulative fixing plate which is damaged when overheating.

The insulative fixing plate damaged when overheating is used to limit two conductive elements from contacting with each other, thereby forming a closed path. In addition, the insulative fixing plate is damaged when overheating, such that the two conductive elements can be opened with respective to each other by an elastic force, thereby forming an open circuit. Each of the said two conductive elements is provided with a groove which is concaved in from an edge of the said conductive element. The grooves are provided with a groove width and the grooves on the two conductive elements are opposite to each other.

The insulative fixing plate damaged when overheating includes a connecting element and two limiting elements. The connecting element is an insulative body and is put into the grooves. The connecting element is damaged when overheating. The two limiting elements are an insulative body and are combined respectively at an end of the connecting element. The two limiting elements are provided respectively with a working width which is larger than the groove width. A holding space is defined between the two limiting elements to contain the two conductive elements, enabling the two limiting elements to be abutted at an exterior side of the conductive element respectively and limiting the two conductive elements from contacting with each other.

Furthermore, at least a part of the connecting element is provided with a width of 0.1 cm to 1.2 cm. Moreover, at least a part of the connecting element is provided with a width of 0.7 cm.

Furthermore, at least an end part of the limiting element is provided with a guide-in part which is enlarged gradually.

Furthermore, any one of the two limiting elements is in a configuration of sphere, hemi-sphere, plate, cone or block.

Furthermore, two ends of the connecting element are thicker, whereas a middle section of the connecting element is thinner. The thickness of the middle section is between 0.1 cm and 1.2 cm.

Furthermore, the connecting element is a plate which is provided with a long edge. The connecting element is provided with a through-hole and the shortest distance from the rim of the through-hole to the long edge is between 0.1 cm and 1.2 cm.

Furthermore, at least a connecting element is connected together with that connecting element, between the two limiting elements.

Furthermore, the extended length of the connecting element is not larger than the depth of the groove.

The present invention also discloses a plug using the insulative fixing plate which is damaged when overheating. The plug includes an insulative unit, a live wire pin, a neutral line pin, a live wire and a neutral line. The live wire pin and the neutral line pin are all disposed in the insulative unit and extended out of the insulative unit. Besides that, the live wire pin and the neutral wire pin are provided respectively with a first groove which is concaved in from an edge of the live wire pin and from an edge of the neutral line pin. The live wire and the neutral line are provided respectively with a second groove which is concaved in from an edge of the live wire and from an edge of the neutral line.

By putting the connecting element of the insulative fixing plate damaged when overheating into the first groove of the live wire pin and the second groove of the live wire, and using the limiting elements of the insulative fixing plate damaged when overheating to restrain the live wire pin and the live wire, the live wire pin and the live wire can contact with each other to form a closed path; and by putting the connecting element of the insulative fixing plate damaged when overheating into the first groove of the neutral line pin and the second groove of the neutral line, and using the limiting elements of the insulative fixing plate damaged when overheating to restrain the neutral line pin and the neutral line, the neutral line pin and the neutral line can contact with each other to form a closed path. The connecting element is damaged when overheating, so that by an elastic force, the live wire pin is opened with respect to the live wire and the neutral line wire is opened with respect to the neutral line, thereby forming an open circuit.

Furthermore, the live wire pin and the live wire are extended along a same direction, whereas the neutral line pin and the neutral line are extended along a same direction.

Furthermore, the live wire pin is extended along a direction perpendicular to the direction along which the live wire is extended, and the neutral line pin is extended along a direction perpendicular to the direction along which the neutral line is extended.

The present invention also discloses a socket using the insulative fixing plate which is damaged when overheating. The socket includes an insulative unit, a live wire terminal, a neutral line terminal, a live wire and a neutral line. The insulative unit is provided at least with a live wire receptacle and a corresponding neutral line receptacle. The live wire terminal is installed in the insulative unit, opposite to the live wire receptacle. The neutral line terminal is installed in the insulative unit, opposite to the neutral line receptacle. The live wire terminal and the neutral line terminal are provided respectively with a first groove which is concaved in from an edge of the live wire terminal and from an edge of the neutral line terminal. The live wire corresponds to the live wire terminal, and the neutral line corresponds to the neutral line terminal. In addition, the live wire and the neutral line are provided respectively with a second groove.

By putting the connecting element of the insulative fixing plate damaged when overheating into the first groove of the live wire terminal and the second groove of the live wire, and using the limiting elements of the insulative fixing plate damaged when overheating to restrain the live wire terminal and the live wire, the live wire terminal and the live wire can contact with each other to form a closed path; and by putting the connecting element of the insulative fixing plate damaged when overheating into the first groove of the neutral line terminal and the second groove of the neutral line, and using the limiting elements of the insulative fixing plate damaged when overheating to restrain the neutral line terminal and the neutral line, the neutral line terminal and the neutral line can contact with each other to form a closed path. Furthermore, the connecting element is damaged when overheating, so that by an elastic force, the live wire terminal is opened with respect to the live wire and the neutral line terminal is opened with respect to the neutral line, thereby forming an open circuit.

The benefits of the present invention include that:

1. By putting the connecting element into the grooves of the two conductive elements, and then using the limiting elements to clamp tightly and fix the two conductive elements, the sufficient rigidity of combination can be formed to combine and position the two conductive elements of the protected circuit, so that under a normal condition of use, there will be no false action caused by the ejection-off of the two conductive elements due to the elastic force between the two conductive elements.
2. The connecting element is put into the grooves of the two conductive elements, and it is preferred that the extended length of the connecting element is not larger than the depth of the grooves. Therefore, when the connecting element is damaged when overheating, two limiting elements can be assured to be ejected off by being subjected uniformly to the elasticity between the two conductive elements, so that the two conductive elements can be opened actually with respect to each other to power off the circuit.
3. The grooves on the two conductive elements are concaved in from the edges of the two conductive elements, facilitating a user to put the connecting element of the insulative fixing plate damaged when overheating into the grooves directly.
4. At least a part of the connecting element is provided with a thickness of 0.1 cm to 1.2 cm, preferably 3 cm. Therefore, when the protected circuit is heated up to 130° C. to 140° C., the degree at which the connecting element is melted by heating can assure that the two conductive elements can be ejected off by the elastic force, thereby actually powering down the protected circuit.
5. In the present embodiment, the limiting elements can be a sphere, hemi-sphere, plate or any combination thereof. In addition, several limiting elements in various configurations are disclosed as the description. However, the present embodiment is not limited by the abovementioned configurations, and as long as that the working width of the limiting element is larger than the groove width of the groove on the conductive element, the insulative fixing plate damaged when overheating can be combined on the two conductive elements to limit the two conductive elements from contacting with each other.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

According to the abovementioned technical features, the primary benefits of the insulative fixing plate damaged when overheating as well as a plug and a socket using that insulative fixing plate can be clearly disclosed in the following embodiment.

Figure 1:
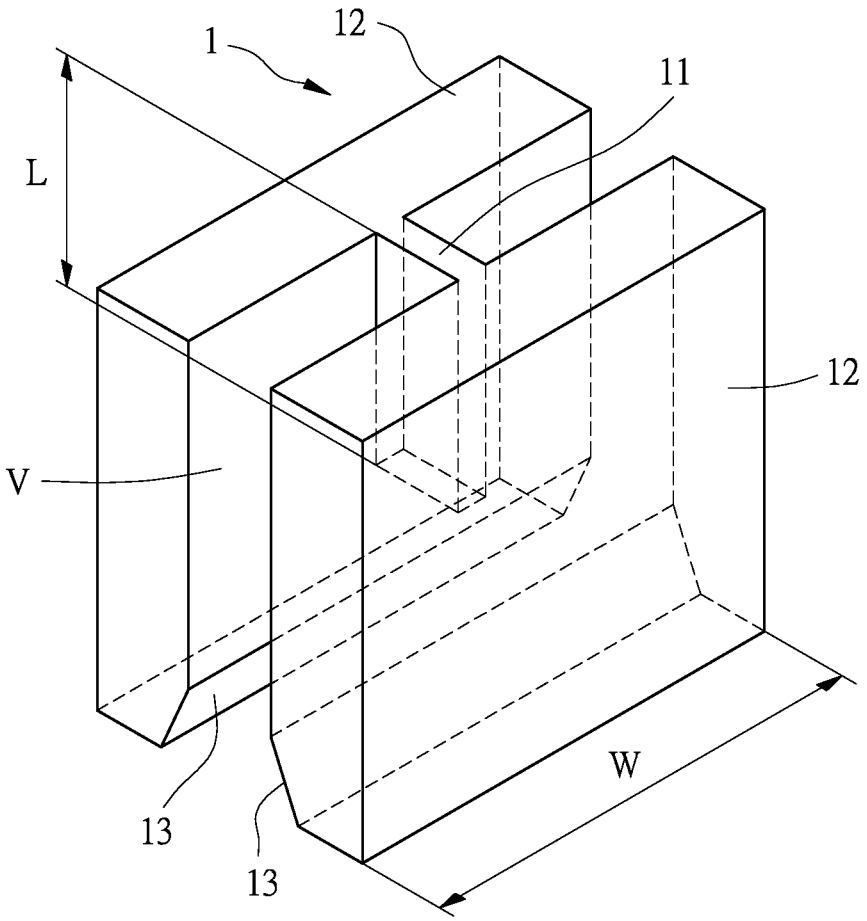
FIG. 1 shows a three-dimensional view of appearance of an insulative fixing plate damaged when overheating, according to an embodiment of the present invention.
Figure 2:
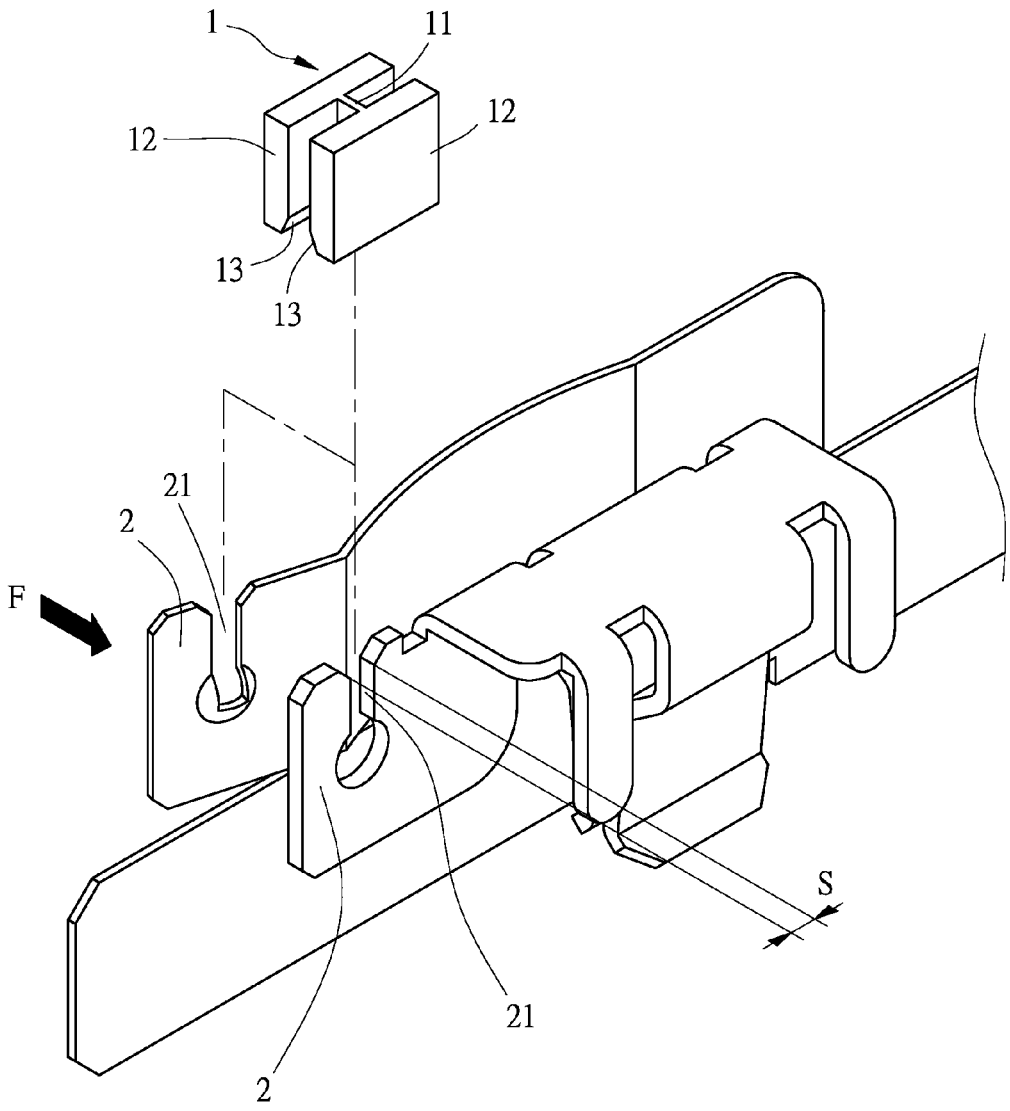
FIG. 2 shows a three-dimensional exploded view illustrating the combination of the insulative fixing plate damaged when overheating with two conductive elements, according to the embodiment of the present invention.

Referring to FIG. 1, an insulative fixing plate damaged when overheating 1, according to the present embodiment, comprises a connecting element 11 and two limiting elements 12 which are combined at two ends of the connecting element 11. The thickness of the connecting element 11 is between 0.1 cm and 1.2 cm, and is 0.7 cm in the present embodiment. A holding space V is defined between the two limiting elements 12 and at least an end part of the two limiting elements 12 is provided with a guide-in part 13 which is enlarged gradually. In addition, the connecting element 11 and the two limiting elements 12 are all an insulative body.

Figure 3:
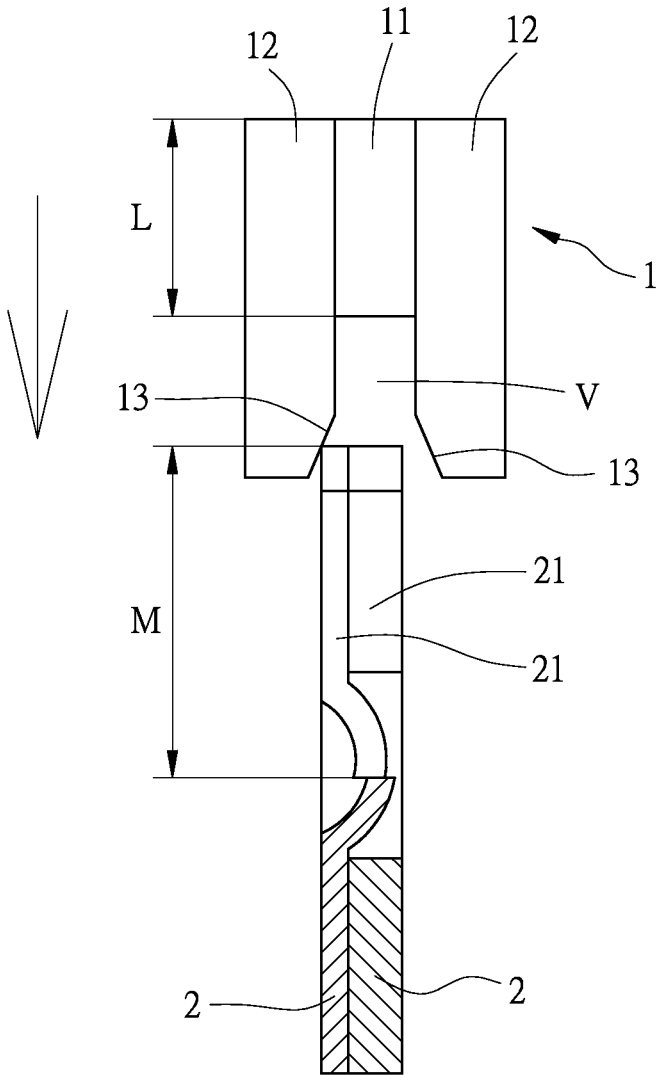
FIG. 3 shows a schematic view illustrating that a guide-in part is used to facilitate putting two conductive elements into a holding space of the insulative fixing plate damaged when overheating, according to the embodiment of the present invention.
Figure 4:
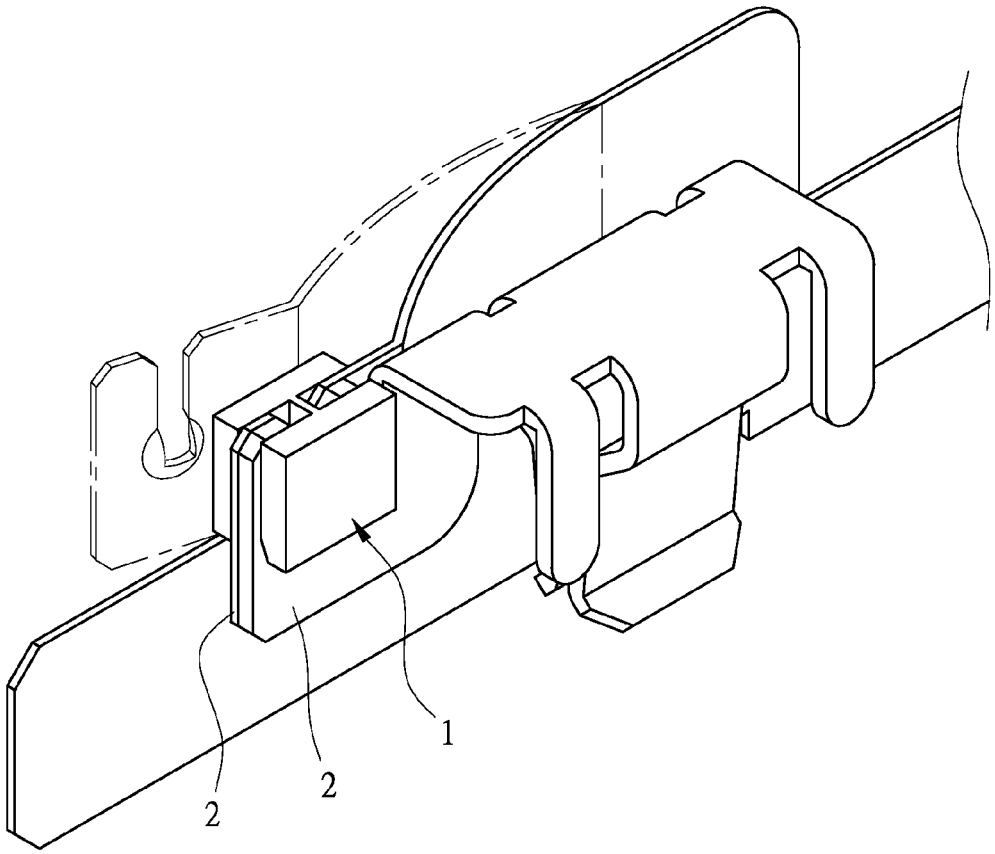
FIG. 4 shows a three-dimensional view of assembly illustrating the combination of the insulative fixing plate damaged when overheating with two conductive elements, according to the embodiment of the present invention.
Figure 5:
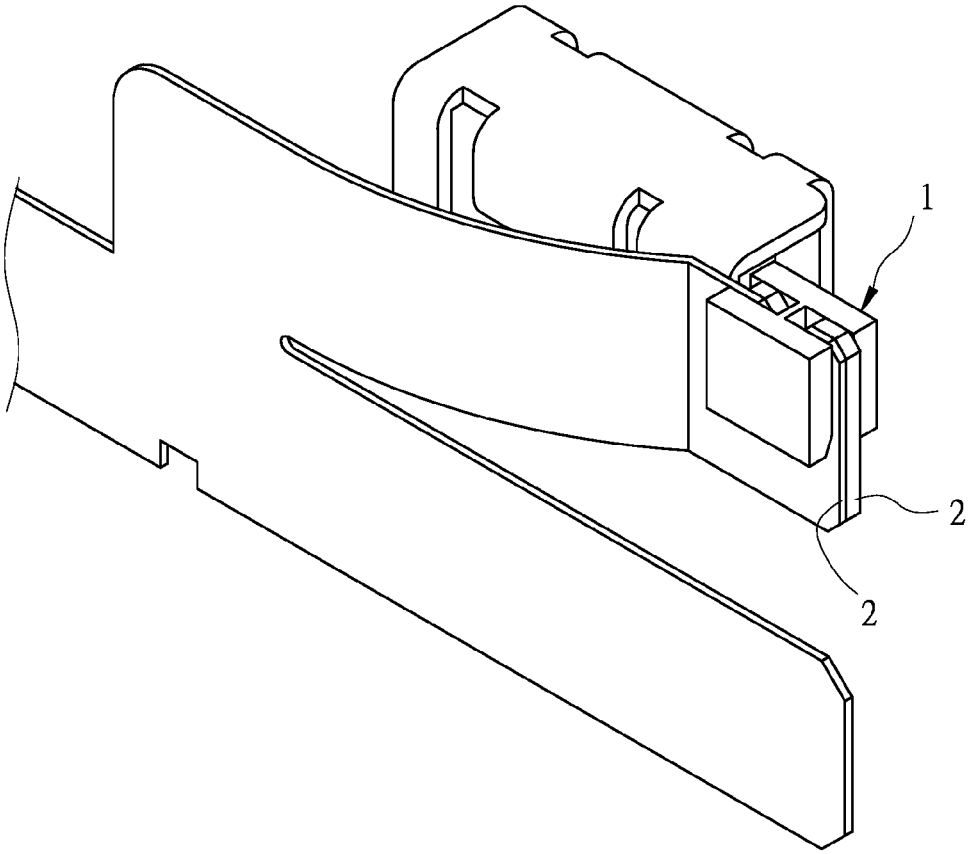
FIG. 5 shows a three-dimensional view of assembly illustrating the combination of the insulative fixing plate damaged when overheating with two conductive elements along another direction, according to the embodiment of the present invention.

Referring to FIGS. 1 to 5, the insulative fixing plate damaged when overheating 1 is combined on two conductive elements 2 of a protected circuit, wherein the two conductive elements 2 are separated and do not contact with each other under the initial state. Each of the said two conductive elements 2 is provided with a groove 21 which is concaved in from an edge of the aforementioned conductive element 2. The groove 21 is provided with a groove width S, and the grooves 21 on the two conductive elements 2 are opposite to each other. An external force F is applied first to enable the two conductive elements 2 to close to and contact with each other. Next, the connecting element 11 of the insulative fixing plate damaged when overheating 1 is put transversely in the grooves 21 of the two conductive elements 2, allowing the two conductive elements 2 to be contained in the holding space V. As the grooves 21 on the two conductive elements 2 are concaved in from the edges of the two conductive elements 2, a user can put the connecting element 11 of the insulative fixing plate damaged when overheating 1 into the grooves 21 easily and directly, and the guide-in part 13 can easily guide the connecting element 11 into the grooves 21 (as shown in FIG. 3). In addition, the extended length L of the connecting element 11 is not larger than the depth M of the grooves 21, and each of the two limiting elements 12 is provided with a working width W which is larger than the groove width S. Therefore, when the two conductive elements 2 are contained in the holding space V, the two limiting elements 12 can be abutted at the external sides of the two conductive elements 2 and the two conductive elements 2 can be limited from contacting with each other to form a closed path.

Figure 6:
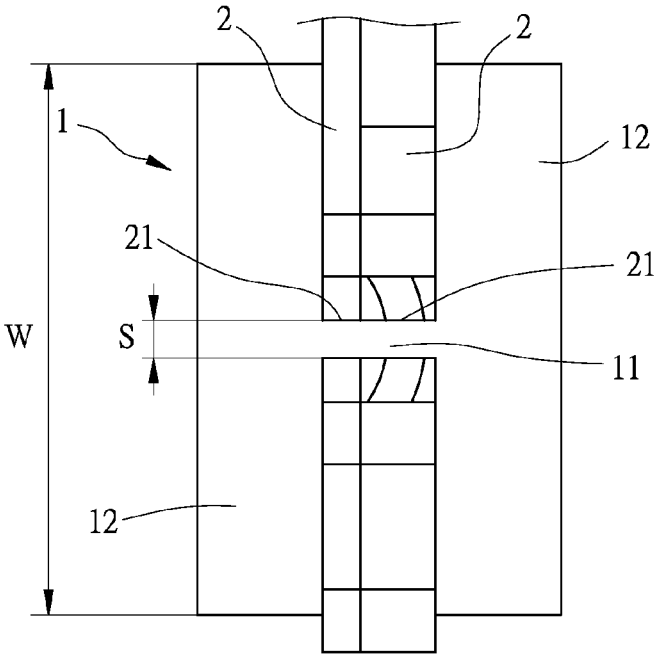
FIG. 6 shows a schematic view illustrating the combination of the insulative fixing plate damaged when overheating with two conductive elements, limiting the two conductive elements from contacting with each other, according to the embodiment of the present invention.

Referring to FIG. 6, in the abovementioned method, the connecting element 11 is put into the grooves 21 of the two conductive elements 2, and then the two conductive elements 2 are clamped tightly and fixed by the limiting elements 12. This method provides sufficient rigidity of combination to combine and position the two conductive elements 2 of the protected circuit.

Figure 7:
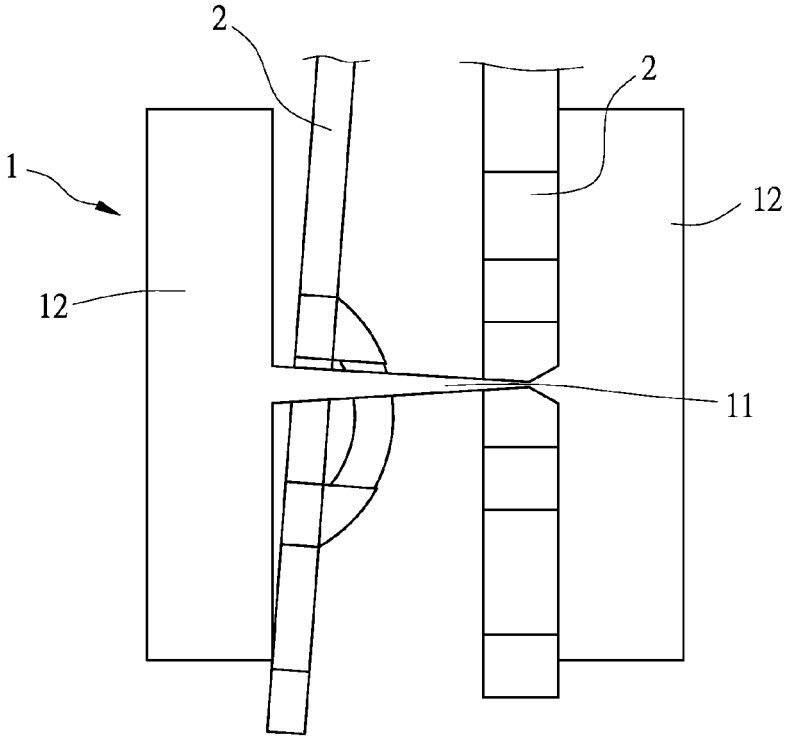
FIG. 7 shows a schematic view illustrating that as a protected circuit is overheated, the insulative fixing plate damaged when overheating is melted to reduce a binding force, so that the two conductive elements are opened with respect to each other by an elastic force, according to the embodiment of the present invention.
Figure 8:
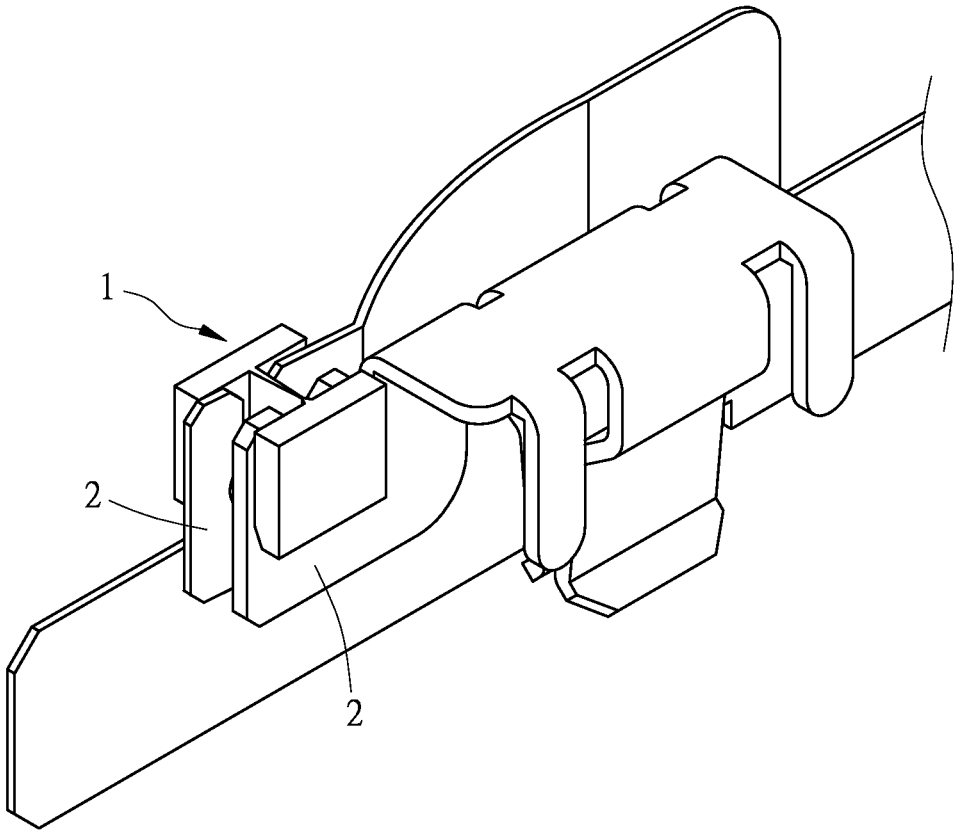
FIG. 8 shows a three-dimensional view of appearance illustrating that as the protected circuit is overheated, the insulative fixing plate damaged when overheating is melted to reduce the binding force, so that the two conductive elements are opened with respect to each other by an elastic force, according to the embodiment of the present invention.

Referring to FIG. 7 and FIG. 8, when the two conductive elements 2 are overheated to about 110° C. to 160° C. by current overloading, false contact or other reason of the protected circuit, with 135° C. to 140° C. as an example in the present embodiment, the insulative fixing plate damaged when overheating 1 will be melted and softened by heat, which reduces the binding force. At this time, the elastic force between the two conductive elements 2 will be released, such that the two conductive elements 2 can be opened with respect to each other to form an open circuit, thereby avoiding a danger of fire by overheating. The thickness of the connecting element 11 is between 0.1 cm and 1.2 cm, assuring that when the connecting element 11 is softened by overheating, the elastic force between the two conductive elements 2 is strong enough to overcome the binding force to eject off the conductive elements 2. As the connecting element 11 is put into the grooves 21 of the two conductive elements 2, and the extended length of the connecting element 11 is not larger than the depth of the grooves 21, when the connecting element 11 is damaged by heat, the two limiting elements 12 can be assured to be subjected to the elastic force between the two conductive elements 2 uniformly and to be ejected off, which enables the two conductive elements 2 to be actually opened with respect to each other, thereby forming an open circuit.

Figure 9:
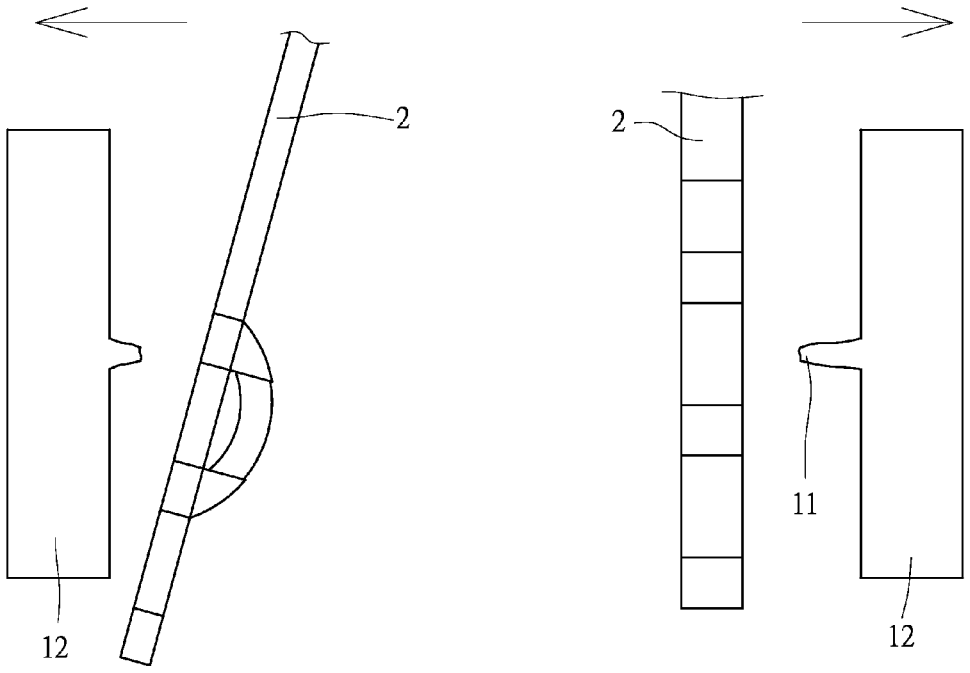
FIG. 9 shows a schematic view illustrating that as the protected circuit is overheated, the insulative fixing plate damaged when overheating is melted and broken, so that the two conductive elements are opened with respect to each other by an elastic force, according to the embodiment of the present invention.
Figure 10:
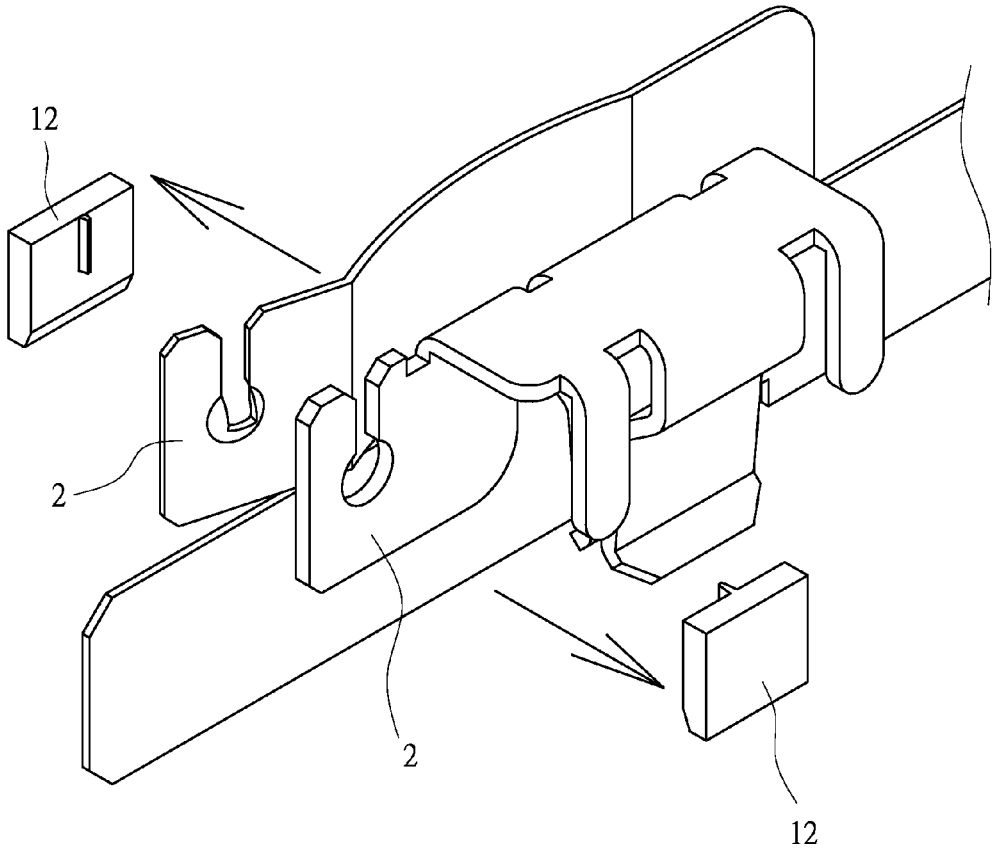
FIG. 10 shows a three-dimensional view of appearance illustrating that as the protected circuit is overheated, the insulative fixing plate damaged when overheating is melted and broken, so that the two conductive elements are opened with respect to each other by an elastic force, according to the embodiment of the present invention.
Figure 11:
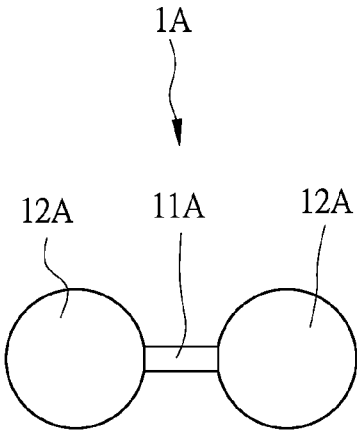
FIG. 11 shows a schematic view of another configuration of the insulative fixing plate damaged when overheating, according to the embodiment of the present invention.

Referring to FIG. 9 and FIG. 10, as the insulative fixing plate damaged when overheating 1 is made of an insulative material, even when the connecting element 11 is broken by melting to eject off the two limiting elements 12 freely, the insulation property of the insulative fixing plate damaged when overheating 1 can prevent the insulative fixing plate from contacting with surrounding electronic elements by mistake to cause short-circuit, thereby securing the safety after forming an open circuit.

Figure 12:
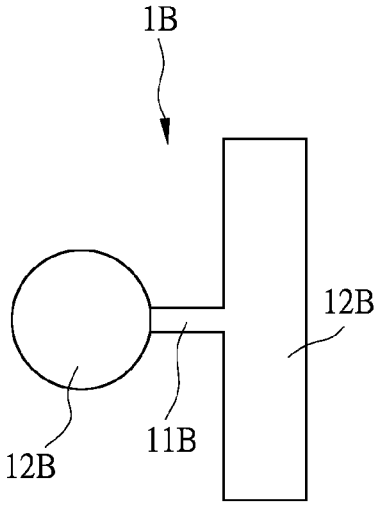
FIG. 12 shows a schematic view of another configuration of the insulative fixing plate damaged when overheating, according to the embodiment of the present invention.
Figure 13:
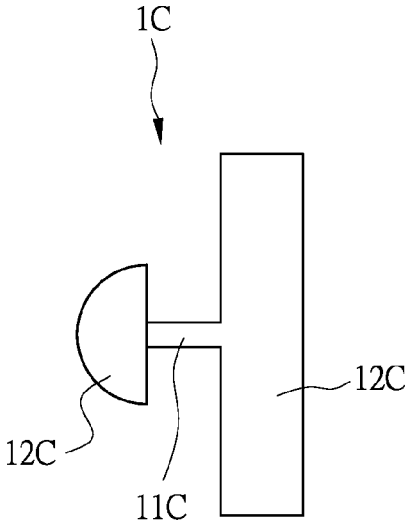
FIG. 13 shows a schematic view of another configuration of the insulative fixing plate damaged when overheating, according to the embodiment of the present invention.
Figure 14:
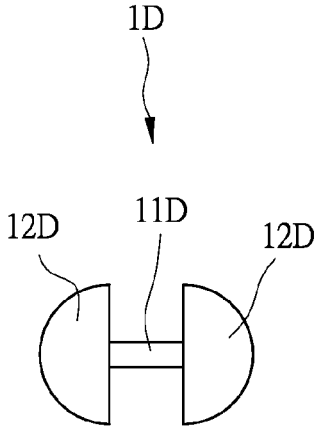
FIG. 14 shows a schematic view of another configuration of the insulative fixing plate damaged when overheating, according to the embodiment of the present invention.
Figure 15:
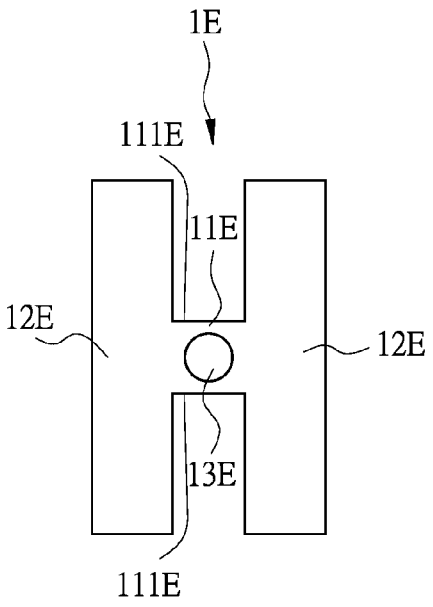
FIG. 15 shows a schematic view of another configuration of the insulative fixing plate damaged when overheating, according to the embodiment of the present invention.
Figure 16:
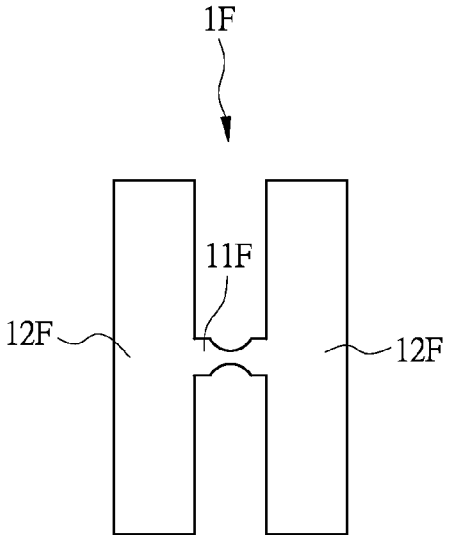
FIG. 16 shows a schematic view of another configuration of the insulative fixing plate damaged when overheating, according to the embodiment of the present invention.
Figure 17:
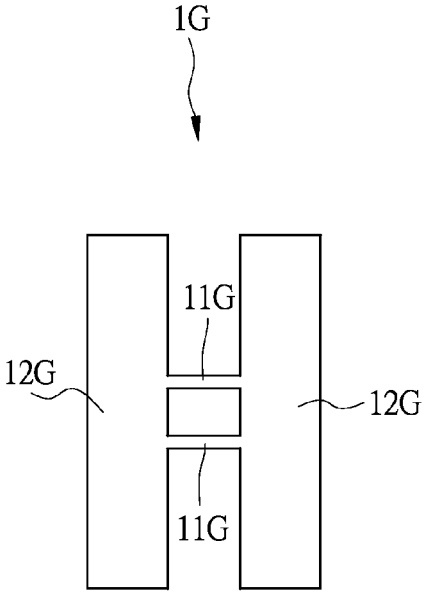
FIG. 17 shows a schematic view of another configuration of the insulative fixing plate damaged when overheating, according to the embodiment of the present invention.

Referring to FIGS. 11 to 17, FIG. 11 shows an insulative fixing plate damaged when overheating 1A, which is provided with a connecting element 11A and two limiting elements 12A combined at two ends of the connecting element 11A, with that the two limiting elements 12A are all in a spherical shape; FIG. 12 shows an insulative fixing plate damaged when overheating 1B, which is provided with a connecting element 11B and two limiting elements 12B combined at two ends of the connecting element 11B, with that the one limiting element 12B is in a spherical shape and the other limiting element 12B is a plate; FIG. 13 shows an insulative fixing plate damaged when overheating 1C, which is provided with a connecting element 11C and two limiting elements 12C combined at two ends of the connecting element 11C, with that the one limiting element 12C is in a hemi-spherical shape and the other limiting element 12C is a plate; FIG. 14 shows an insulative fixing plate damaged when overheating 1D, which is provided with a connecting element 11D and two limiting elements 12D combined at two ends of the connecting element 11D, with that the two limiting elements 12D are all in a hemi-spherical shape; FIG. 15 shows an insulative fixing plate damaged when overheating 1E, which is provided with a connecting element 11E and two limiting elements 12E combined at two ends of the connecting element 11E, with that the connecting element 11E is a plate which is provided with a long edge 111E and a through-hole 13E, and the shortest distance from the rim of the through-hole 13E to the long edge 111E is between 0.1 cm and 1.2 cm; FIG. 16 shows an insulative fixing plate damaged when overheating 1F, which is provided with a connecting element 11F and two limiting elements 12F combined at two ends of the connecting element 11F, with that two ends of the connecting element 11F are thicker, a middle section is thinner and the thickness of the middle section is between 0.1 cm and 1.2 cm; and FIG. 17 shows an insulative fixing plate damaged when overheating 1G which is provided with at least two connecting elements 11G and two limiting elements 12G combined at two ends of the connecting elements 11G.

FIGS. 11 to 17 list all kinds of configurations of the limiting elements, primarily describing that no matter what kind of configuration of the limiting elements is, such as a cone or other regular or irregular block not shown in the drawings, merely depending upon the convenience in processing of a processing machine, as long as the working width of the limiting element is larger than the groove width of the groove on the conductive element, the insulative fixing plate damaged when overheating can be combined on the two conductive elements to limit the two conductive elements from contacting with each other.

Figure 18:
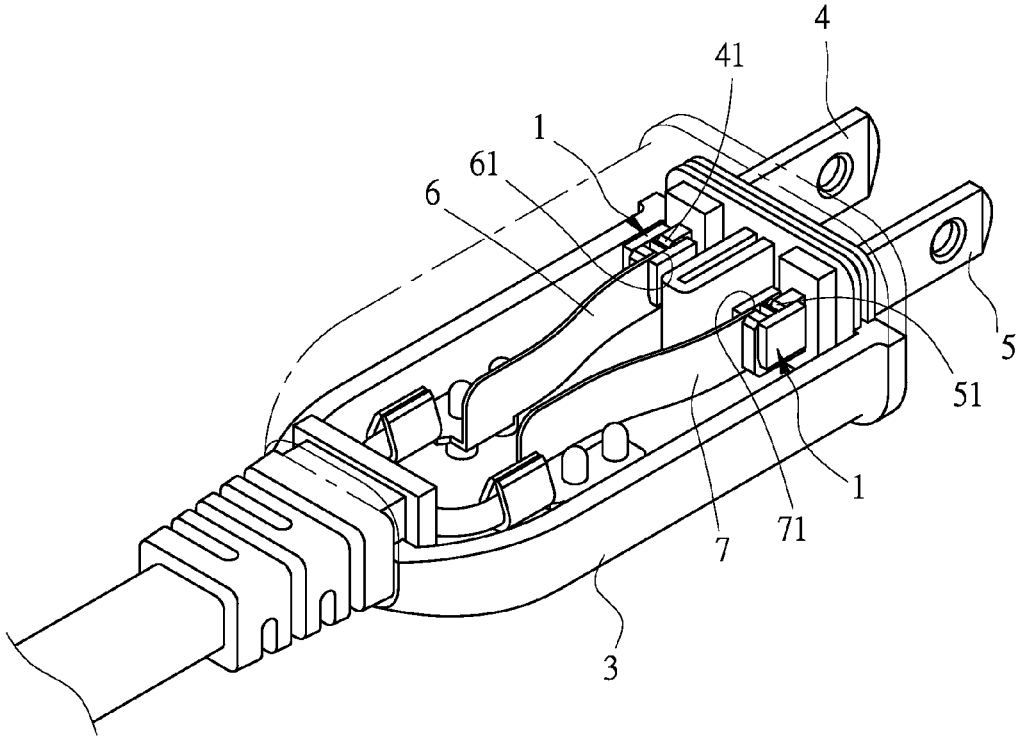
FIG. 18 shows a schematic view illustrating that the insulative fixing plate damaged when overheating is used in a plug, wherein a live wire pin and a live wire are extended along a same direction, and a neutral line pin and a neutral line are extended along a same direction, according to the present invention.

Referring to FIG. 1 and FIG. 18, the insulative fixing plate damaged when overheating 1, is used in overheat protection for a plug. The plug of the present embodiment comprises an insulative unit 3, a live wire pin 4, a neutral line pin 5, a live wire 6 and a neutral line 7. The live wire pin 4 and the neutral line pin 5 are all disposed in the insulative unit 3 and extended out of the insulative unit 3. The live wire pin 4 and the neutral line pin 5 are provided respectively with a first groove 41, 51. The first groove 41 is concaved in from an edge of the live wire pin 4, and the first groove 51 is concaved in from an edge of the neutral line pin 5. The live wire 6 and the neutral line 7 correspond to the live wire pin 4 and the neutral line pin 5, respectively. In addition, the live wire 6 and the neutral line 7 are provided respectively with a second groove 61, 71 corresponding to the first groove 41, 51. The second groove 61 is concaved in from an edge of the live wire 6, and the second groove 71 is concaved in from an edge of the neutral line 7. Furthermore, the live wire pin 4 and the live wire 6 are extended along a same direction, and the neutral line pin 5 and the neutral line 7 are extended along a same direction.

By putting the connecting element 11 of the insulative fixing plate damaged when overheating 1 into the first groove 41 of the live wire pin 4 and the second groove 61 of the live wire 6, and using the limiting elements 12 of the insulative fixing plate damaged when overheating 1 to restrain the live wire pin 4 and live wire 6, the live wire pin 4 and the live wire 6 can contact with each other to form a closed path; and by putting the connecting element 11 of the insulative fixing plate damaged when overheating 1 into the first groove 51 of the neutral line pin 5 and the second groove 71 of the neutral line 7, and using the limiting elements 12 of the insulative fixing plate damaged when overheating 1 to restrain the neutral line pin 5 and neutral line 7, the neutral line pin 5 and the neutral line 7 can contact with each other to form a closed path. Furthermore, the connecting element 11 can be melted down when overheating, such that the live wire pin 4 and the live wire 6 can be opened with respect to each other and the neutral line pin 5 and the neutral line 7 can be opened with respect to each other by an elastic force, thereby forming an open circuit.

Figure 19:
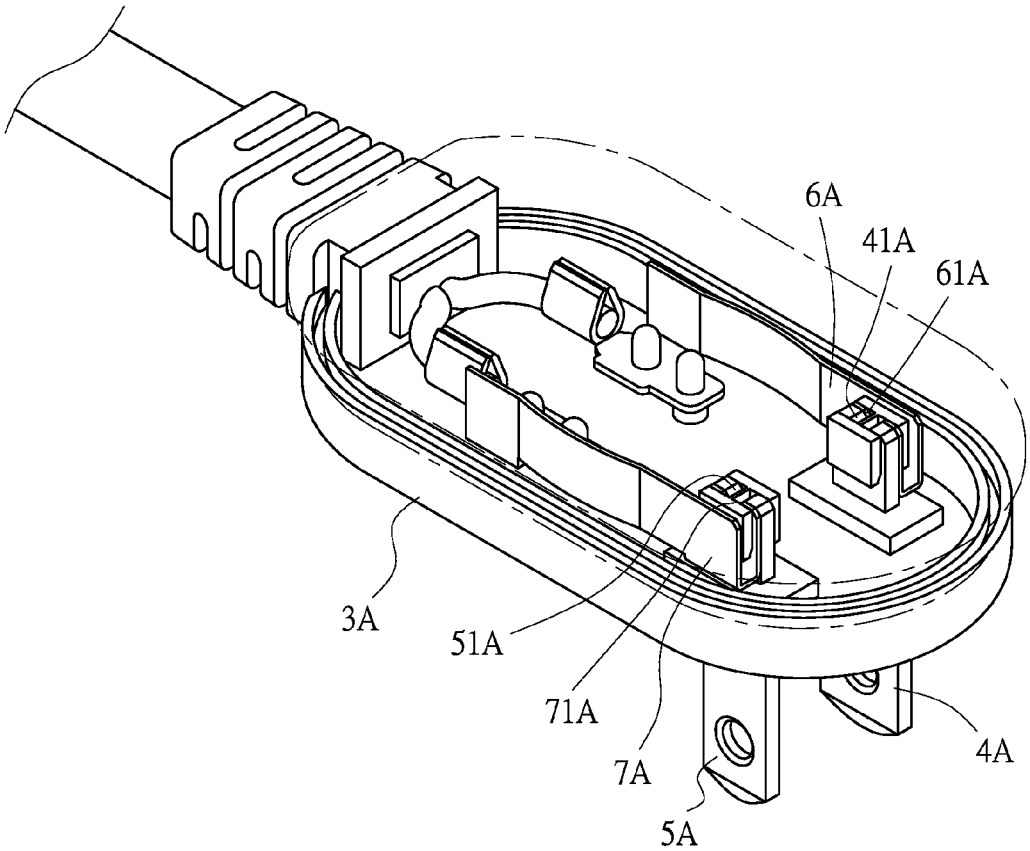
FIG. 19 shows an overall schematic view illustrating that the insulative fixing plate damaged when overheating is used in the plug, wherein the live wire pin is extended along a direction perpendicular to the direction along which the live wire is extended, and the neutral line pin is extended along a direction perpendicular to the direction along which the neutral line is extended, according to the present invention.

As shown in FIG. 19, other than the abovementioned plug, the insulative fixing plate damaged when overheating can be also used in another type of plug. This plug comprises an insulative unit 3A, a live wire pin 4A, a neutral line pin 5A, a live wire 6A and a neutral line 7A. The live wire pin 4A and the neutral line pin 5A are all disposed in the insulative unit 3A and extended out of the insulative unit 3A. The live wire pin 4A and the neutral line pin 5A are provided respectively with a first groove 41A, 51A. The first groove 41A is concaved in from an edge of the live wire pin 4A, and the first groove 51A is concaved in from an edge of the neutral line pin 5A. The live wire 6A and the neutral line 7A correspond to the live wire pin 4A and the neutral line pin 5A, respectively. In addition, the live wire 6A and the neutral line 7A are provided respectively with a second groove 61A, 71A corresponding to the first groove 41A, 51A. The second groove 61A is concaved in from an edge of the live wire 6A, and the second groove 71A is concaved in from an edge of the neutral line 7A. Besides that, the live wire pin 4A is extended along a direction perpendicular to the direction along which the live wire 6A is extended; and the neutral line pin 5A is extended along a direction perpendicular to the direction along which the neutral line 7A is extended. In other words, the first grooves are provided to fit with the configurations of the live wire pin and the neutral line pin, whereas the second grooves are provided to fit with the configurations of the live wire and the neutral line.

Figure 20:
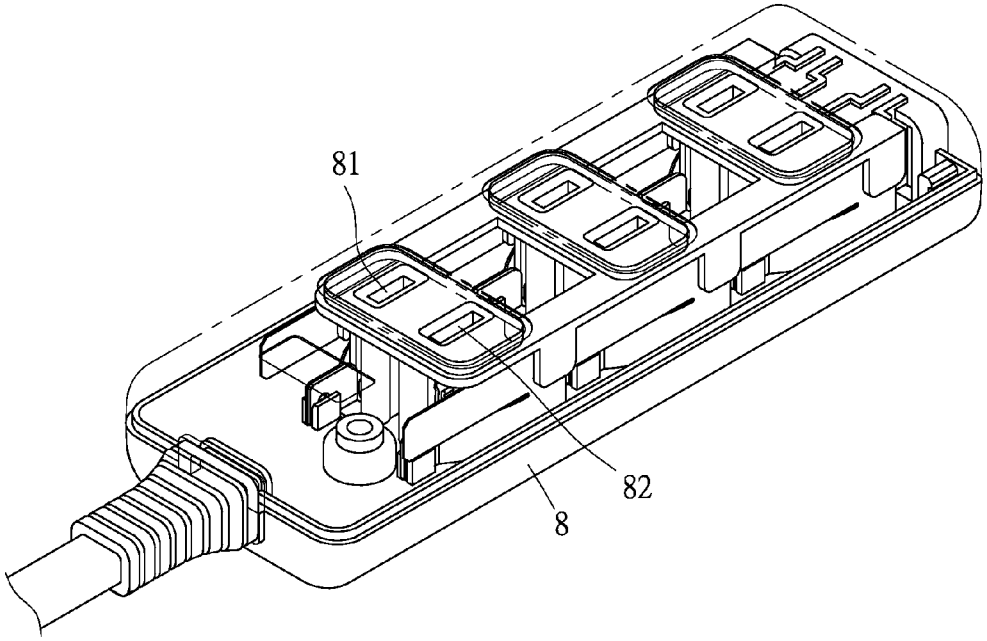
FIG. 20 shows a first schematic view illustrating that the insulative fixing plate damaged when overheating is used in a socket, according to the present invention.
Figure 21:
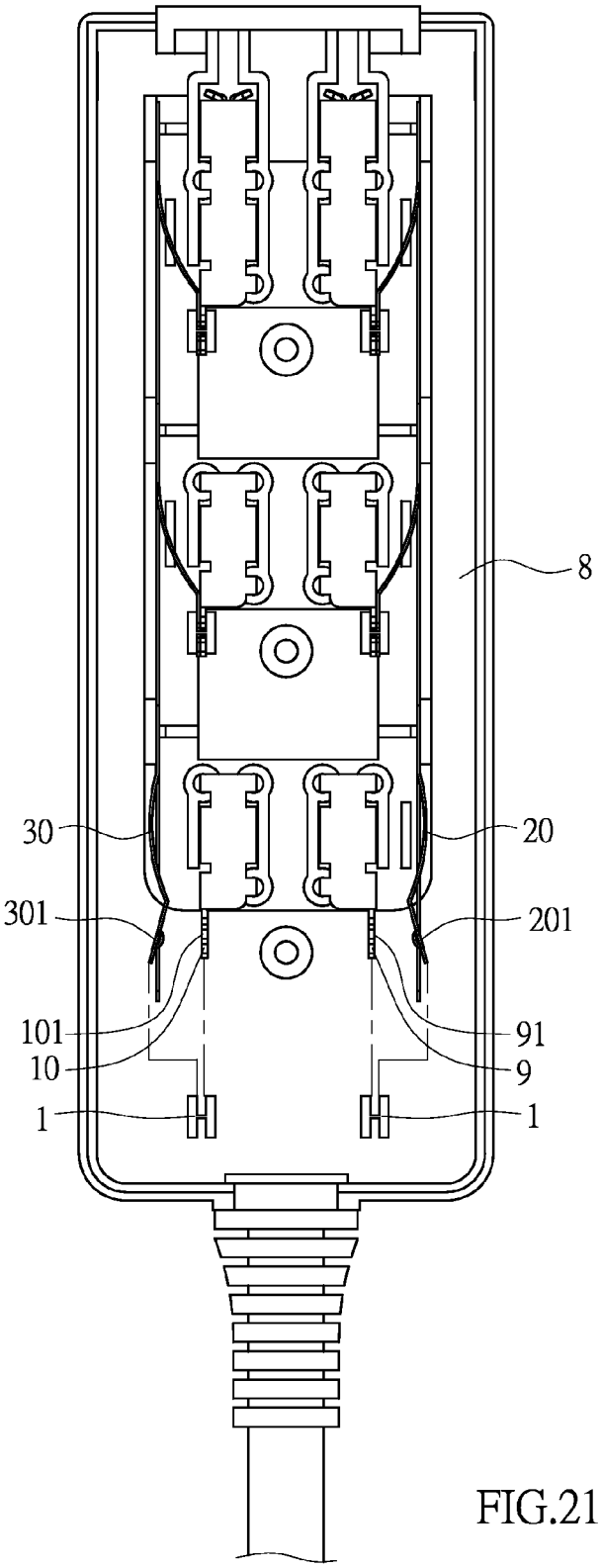
FIG. 21 shows a second schematic view illustrating the insulative fixing plate damaged when overheating is used in the socket, according to the present invention.

Referring to FIG. 1, FIG. 20 and FIG. 21, the insulative fixing plate damaged when overheating 1 is used in overheat protection for a socket. The socket of the present embodiment comprises an insulative unit 8 which is provided with a live wire receptacle 81 and a corresponding neutral line receptacle 82; a live wire terminal 9 which is installed in the insulative unit 8 and corresponds to the live wire receptacle 81, and a neutral line terminal 10 which is installed in the insulative unit 8 and corresponds to the neutral line receptacle 82, with that the live wire terminal 9 and the neutral line terminal 10 are provided respectively with a first groove 91, 101 concaved in from an edge of the live wire terminal 9 and from an edge of the neutral line terminal 10; a live wire 20 which corresponds to the live wire terminal 9, and a neutral line 30 which corresponds to the neutral line terminal 10, with that the live wire 20 and the neutral line 30 are provided respectively with a second groove 201, 301 corresponding to the first groove 91, 101, and with that the second grooves 201, 301 are concaved in from an edge of the live wire 20 and from an edge of the neutral line 30.

By putting the connecting element 11 of the insulative fixing plate damaged when overheating 1 into the first groove 91 of the live wire terminal 9 and the second groove 201 of the live wire 20, and using the limiting elements 12 of the insulative fixing plate damaged when overheating 1 to restrain the live wire terminal 9 and the live wire 20, the live wire terminal 9 and the live wire 20 can contact with each other to form a closed path; and by putting the connecting element 11 of the insulative fixing plate damaged when overheating 1 into the first groove 101 of the neutral line terminal 10 and the second groove 301 of the neutral line 30, and using the limiting elements 12 of the insulative fixing plate damaged when overheating 1 to restrain the neutral line terminal 10 and the neutral line 30, the neutral line terminal 10 and the neutral line 30 can contact with each other to form a closed path. In addition, the connecting element 11 will be damaged by melting when overheating, such that by an elastic force, the live wire terminal 9 and the live wire 20 can be opened with respect to each other, whereas the neutral line terminal 10 and the neutral line 30 can be opened with respect to each other, thereby forming an open circuit.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An insulative fixing plate damaged when overheating, being used to limit two conductive elements from contacting with each other to form a closed path, and the insulative fixing plate being damaged when overheating, allowing the two conductive elements to be opened with respect to each other by an elastic force to form an open circuit, with each of the two conductive elements being provided with a groove which is concaved in from an edge of the conductive element, the groove being provided with a groove width, the grooves on the two conductive elements being opposite to each other, and the insulative fixing plate damaged when overheating, comprising:

a connecting element which is an insulative body and is put into the grooves, with the connecting element being damaged when overheating; and two limiting elements which are an insulative body and are combined at two ends of the connecting element, with each of the two limiting elements being provided with a working width which is larger than the groove width, a holding space being defined between the two limiting elements to contain the two conductive elements, allowing the two limiting elements to be abutted respectively at an external side of the conductive element, and preventing the two conductive elements from disengaging with each other;

wherein two ends of the connecting element are thicker, a middle section of the connecting element is thinner; and wherein the connecting element is a plate is provided with a long edge.

2. The insulative fixing plate damaged when overheating, according to claim 1, wherein a part of the connecting element is provided with a thickness of 0.1 cm to 1.2 cm.

3. The insulative fixing plate damaged when overheating, according to claim 2, wherein a part of the connecting element is provided with a thickness of 0.7 cm.

4. The insulative fixing plate damaged when overheating, according to claim 1, wherein an end part of the limiting element is provided with a guide-in part which is enlarged gradually.

5. The insulative fixing plate damaged when overheating, according to claim 1, wherein any one of the two limiting elements is a sphere, hemi-sphere, plate, cone or block.

6. The insulative fixing plate damaged when overheating, according to claim 1, wherein the thickness of the middle section is between 0.1 cm and 1.2 cm.

7. The insulative fixing plate damaged when overheating, according to claim 1, wherein the connecting element is provided with a through-hole, with that the shortest distance from a rim of the through-hole to the long edge is between 0.1 cm and 1.2 cm.

8. The insulative fixing plate damaged when overheating, according to claim 1, wherein another connecting element is further connected together with the connecting element in between the two limiting elements.

9. The insulative fixing plate damaged when overheating, according to claim 1, wherein an extended length of the connecting element is not larger than the depth of the groove.

10. A plug using the insulative fixing plate damaged when overheating, according to claim 1, comprising:

an insulative unit;

a live wire pin and a neutral line pin which are all disposed in the insulative unit and extended out of the insulative unit, with that the live wire pin and the neutral line pin are provided respectively with a first groove concaved in from an edge of the live wire pin and from an edge of the neutral line pin; and a live wire and a neutral line which are provided respectively with a second groove concaved in from an edge of the live wire and from an edge of the neutral line;

by putting the connecting element of the insulative fixing plate damaged when overheating into the first groove of the live wire pin and the second groove of the live wire, and using the limiting elements of the insulative fixing plate damaged when overheating to restrain the live wire pin and the live wire, the live wire pin and the live wire contacting with each other to form a closed path; and by putting the connecting element of the insulative fixing plate damaged when overheating into the first groove of the neutral line pin and the second groove of the neutral line, and using the limiting elements of the insulative fixing plate damaged when overheating to restrain the neutral line pin and the neutral line, the neutral line pin and the neutral line contacting with each other to form a closed path; the connecting elements being damaged when overheating, allowing that by an elastic force, the live wire pin and the live wire are opened with respect to each other, and the neutral line pin and the neutral line are opened with respect to each other, thereby forming an open circuit.

11. The plug according to claim 10, wherein the live wire pin and the live wire are extended along a same direction, and the neutral line pin and the neutral line are extended along a same direction.

12. The plug according to claim 10, wherein the live wire pin is extended along a direction perpendicular to the direction along which the live wire is extended, and the neutral line pin is extended along a direction perpendicular to the direction along which the neutral line is extended.

13. The plug according to claim 10, wherein a part of the connecting element is provided with a thickness of 0.1 cm to 1.2 cm.

14. The plug according to claim 10, wherein an end part of the limiting element is provided with a guide-in part which is enlarged gradually.

15. The plug according to claim 10, wherein any one of the two limiting elements is a sphere, hemi-sphere, plate, cone or block.

16. The plug according to claim 10, wherein two ends of the connecting element is thicker, a middle section of the connecting element is thinner, and the thickness of the middle section is between 0.1 cm and 1.2 cm.

17. The plug according to claim 10, wherein the connecting element is a plate, is provided with a long edge and is provided with a through-hole, with that the shortest distance from the rim of the through-hole to the long edge is between 0.1 cm and 1.2 cm.

18. The plug according to claim 10, wherein another connecting element is connected together with the connecting element, between the two limiting elements.

19. The plug according to claim 10, wherein the extended length of the connecting element is not larger than the depth of the groove.

20. A socket using the insulative fixing plate damaged when overheating, according to claim 1, comprising:

an insulative unit which is provided with a live wire receptacle and a neutral line receptacle;

a live wire terminal which is installed in the insulative unit and corresponds to the live wire receptacle, and a neutral line terminal which is installed in the insulative unit and corresponds to the neutral line receptacle, with that the live wire terminal and the neutral line terminal are provided respectively with a first groove concaved in from an edge of the live wire terminal and from an edge of the neutral line terminal; and a live wire which corresponds to the live wire terminal, and a neutral line which corresponds to the neutral line terminal, with that the live wire and the neutral line are provided respectively with a second groove concaved in from an edge of the live wire and from an edge of the neutral line;

by putting the connecting element of the insulative fixing plate damaged when overheating into the first groove of the live wire terminal and the second groove of the live wire, and using the limiting elements of the insulative fixing plate damaged when overheating to restrain the live wire terminal and the live wire, the live wire terminal and the live wire contacting with each other to form a closed path; and by putting the connecting element of the insulative fixing plate damaged when overheating into the first groove of the neutral line terminal and the second groove of the neutral line, and using the limiting elements of the insulative fixing plate damaged when overheating to restrain the neutral line terminal and the neutral line, the neutral line terminal and the neutral line contacting with each other to form a closed path; the connecting element being damaged when overheating, allowing that by an elastic force, the live wire terminal and the live wire are opened with respect to each other, and the neutral line terminal and the neutral line are opened with respect to each other, thereby forming an open circuit.

21. The socket according to claim 20, wherein a part of the connecting element is provided with a thickness of 0.1 cm to 1.2 cm.

22. The socket according to claim 20, wherein an end part of the limiting element is provided with a guide-in part which is enlarged gradually.

23. The socket according to claim 20, wherein any one of the two limiting elements is a sphere, hemi-sphere, plate, cone or block.

24. The socket according to claim 20, wherein two ends of the connecting element is thicker, a middle section of the connecting element is thinner and the thickness of the middle section is between 0.1 cm and 1.2 cm.

25. The socket according to claim 20, wherein the connecting element is a plate, is provided with a long edge and is provided with a through-hole, with that the shortest distance from the rim of the through-hole to the long edge is between 0.1 cm and 1.2 cm.

26. The socket according to claim 20, wherein another connecting element is connected together with the connecting element, between the two limiting elements.

27. The socket according to claim 20, wherein the extended length of the connecting element is not larger than the depth of the groove.

* * * * *